United States Patent [19]

Wantling

[11] 4,004,447

[45] Jan. 25, 1977

[54] METHOD AND APPARATUS FOR COINING AND CURVING LOOPED WIRE

[75] Inventor: Joseph W. Wantling, Wellington, Ohio

[73] Assignee: Wedge Wire Corporation, Wellington, Ohio

[22] Filed: Dec. 10, 1975

[21] Appl. No.: 639,475

[52] U.S. Cl. ..... 72/414; 72/475

[51] Int. Cl.[2] ..... B21C 37/04

[58] Field of Search ..... 72/414, 415, 412, 475, 72/470

[56] References Cited

UNITED STATES PATENTS

| | | | |
|---|---|---|---|
| 133,492 | 11/1872 | Seward | 72/475 |
| 139,413 | 5/1873 | Miller | 72/475 |

FOREIGN PATENTS OR APPLICATIONS

| | | | |
|---|---|---|---|
| 144,811 | 10/1903 | Germany | 72/412 |
| 29,108 | 8/1968 | Japan | 72/412 |

*Primary Examiner*—Milton S. Mehr
*Attorney, Agent, or Firm*—Dybvig & Dybvig

[57] ABSTRACT

Looped wire initially having a circular cross section is, with a single application of pressure between dies, simultaneously coined to a wedge shape and curved in a portion thereof extending between loops.

5 Claims, 7 Drawing Figures

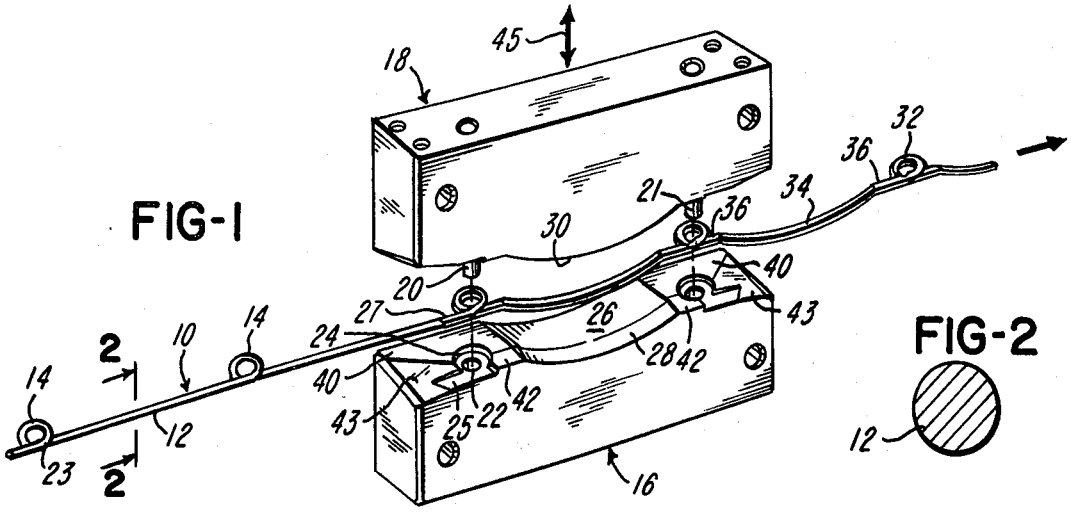
FIG-1
FIG-2
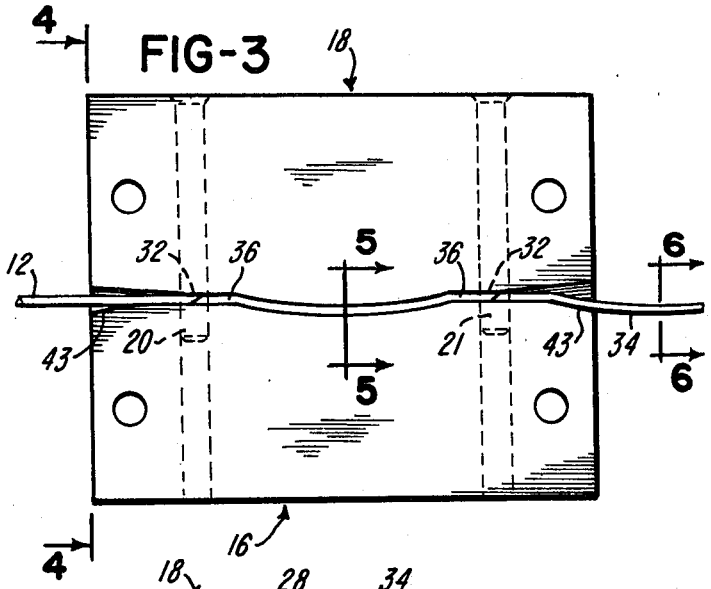
FIG-3
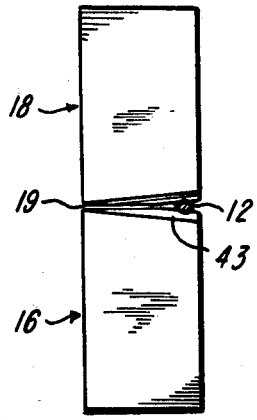
FIG-4
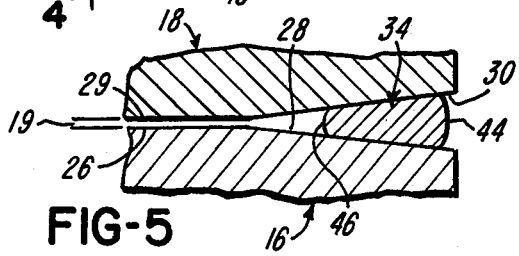
FIG-5
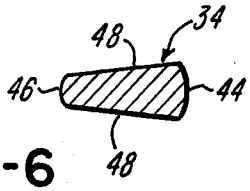
FIG-6
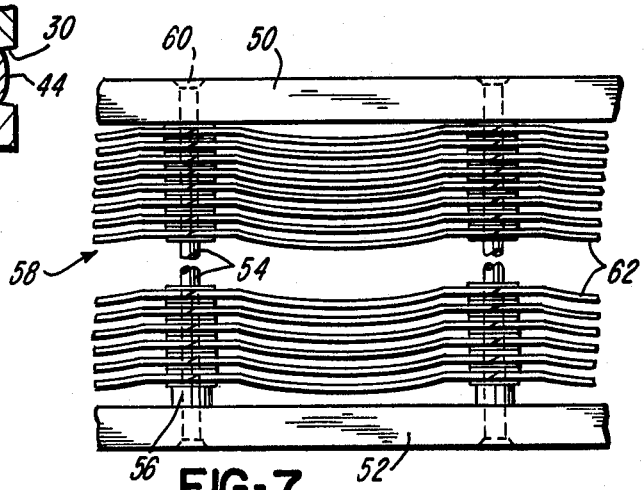
FIG-7

METHOD AND APPARATUS FOR COINING AND CURVING LOOPED WIRE

BACKGROUND OF THE INVENTION

1. Field of the Invention

The present invention relates to the formation of curved crossflow screens and more particularly relates to a method and apparatus for simultaneously shaping initially circular looped wire to wedge-shaped looped wire and curving the sections of the wire extending between adjacent loops.

2. Prior Art

It is known to form looped and curved wedge wire elements for use in crossflow screens by means of an essentially three-step process. In the first step, after the wire has been successively looped along its length, the wire extending between successive loops is coined from an initially circular section to a wedge-shaped section. In the second step, the wedge-shaped sections are curved along the length thereof. In this second step, stresses are developed due to the relative stiffness of the wider side of the wedge-shaped sections, which cause the wedge-shaped sections to twist about their own axes. Accordingly, a third step is required wherein the curved wedge-shaped sections are twisted reversely about the axis of the wire so as to remove strains resulting from the stresses which caused the looped wire to twist about its own axis.

It has been known in the manufacture of carriage clips to simultaneously bend and cross sectionally reform wire-like elements. Examples of techniques employed in the manufacture of carriage clips appear in U.S. Pat. Nos. 133,492 and 139,413.

SUMMARY OF THE INVENTION

In the present invention, wire of circular cross section which has been previously looped at spaced intervals along its length is compressed between appropriately formed dies, which, by a single application of pressure, compress the cross-overs of adjacently spaced loops to a predetermined thickness, coin the initially circular wire extending between such loops to a wedge wire section and, at the same time, curve the wedge wire section along its length. By simultaneously coining and curving the wire under a pressure adequate to effect the coining operation, it has been found that the tendency of the wedge-shaped wire to twist about its own axis when also curved is eliminated, and thus the three-step operation required in the prior art has been simplified to a single-step operation.

BRIEF DESCRIPTION OF THE DRAWINGS

In the drawings:

FIG. 1 is a perspective view illustrating the nature of the dies employed in the present invention and suggestively indicating the manner in which looped wire is simultaneously coined and curved.

FIG. 2 is a section view taken substantially along the line 2—2 of FIG. 1.

FIG. 3 is an elevation view illustrating the dies of FIG. 1 engaged to the looped wire at a time when the dies are in a closed position.

FIG. 4 is a section view taken substantially along the line 4—4 of FIG. 3.

FIG. 5 is a fragmentary section view taken substantially along the line 5—5 of FIG. 3.

FIG. 6 is a section view taken substantially along the line 6—6 of FIG. 3.

FIG. 7 is a fragmentary plan view with portions broken away of a crossflow screen.

DESCRIPTION OF THE PREFERRED EMBODIMENT

Appearing to the left side of FIG. 1 is a conventionally looped wire 10 which comprises spaced apart loops 14 interconnected by relatively straight portions 12. As shown in FIG. 2, the portions 12 are circular in cross section, and the same is true of the portions of the wire strand which formed the loops 14.

The looped wire 10 is indexed into the gap between cooperating dies 16 and 18 by a conventional indexing mechanism, not shown. The indexing mechanism is operated in such a fashion that a given loop 14 is first coaxially aligned with a guide pin 20 securely mounted to the upper die 18, whereupon a press mechanism, not shown, advances the die 18 downwardly toward the die 16 to cause the dies to exert a pressure on the looped wire. The press used to compress the wire between the dies 16 and 18 is preferably of the knuckle-joint type; and, accordingly, the dies are so designed that during press operation their working surfaces do not physically contact one another. Thus, FIGS. 4 and 5, which show the dies at the time the dies are fully closed, illustrate a gap 19 between the dies.

Upon separation of the dies, this being the condition illustrated in FIG. 1, the wire is indexed further between the dies 16 and 18 so as to advance the next loop 14 to coaxial alignment with the guide pin 20. During this second index movement, the loop initially coaxially aligned with the pin 20 is brought into coaxial alignment with a second guide pin 21, also securely affixed to the upper die 18. Accordingly, each loop 14 is twice acted upon by the dies 16 and 18, once when aligned with the pin 20 and a second time when aligned with the pin 21.

As apparent from an inspection of FIG. 1, the die 16 is symmetric about a plane of symmetry which bisects the die. Accordingly, only the working surfaces of the die which appear to the left of the plane of symmetry will be described in detail, it being understood that the working surfaces of the die 16 which are to the right of the plane of symmetry are merely a mirror image of the working surfaces appearing to the left. Similarly, the working surfaces of the die 18 are a mirror image of the working surfaces appearing on the die 16 except that, as is evident, the die 18 has a convexly curved working surface 29, which fits into a concavely curved working surface 26 of the die 16. In the present description, it is thus sufficient to particularly describe features appearing on the left side of the die 16, with the understanding that the die 18 is the mirror image of the die 16 except where otherwise noted.

As appears in FIG. 1, the pin 20 enters an aperture 22 in the die 16 when the die is closed. In surrounding relation to the aperture 22, the die 16 has a recess 24, which is generally circular and concentric to the aperture 22 except for the presence of a tail 25 extending to the left as the die 16 appears in FIG. 1.

It can be noted that the loops 14 each comprise a single strand of circular cross section which crosses over itself to form a cross-over portion 23, which is twice the strand thickness. In the operation of the dies, the cross-over portion 23 is substantially reduced in thickness and at the same time the initially circular wire completing the loop is somewhat flattened. Thus, the recess 24 has a relatively shallow depth in the portion thereof which circularly surrounds the aperture 22 and a slightly greater depth in the portion of the tail 25 which will engage the loop where the wire crosses itself. Accordingly, although the recess 24 may appear to be planar in the drawing, it is stepped downwardly somewhat from the rearmost portion of the recess 24 appearing in FIG. 1 to the frontmost portion of the recess where the tail 25 appears. The equivalent recess in the die 18, which does not appear in the drawing, has a similar variation in depth so that when the dies close, the single strand portion of the loop is flattened to a first thickness and the loop cross-overs which have initially twice single strand thickness are flattened to a second thickness which is greater than the first thickness.

As appears in the drawing, the first compression of a loop 14 will produce a flattening as shown by an indentation 27 on the top face of the loop 14 encircling the pin 20. This flattening results from the mirror image tail formation located in the die 18. Before the dies are again actuated, the loop 14 encircling the pin 20 is indexed between the dies to the right as the dies appear in FIG. 1 to a position where, on next die actuation, the loop will encircle the pin 21. At the commencement of this next die actuation, a segment of relatively straight wire of circular cross section will extend between the loops encircling the respective pins 20 and 21.

As best appears in FIG. 5, the concavely formed surface 26 in the die 16 has its margin beveled to form a concave frustum conic surface 28. As also appears in FIG. 5, the convexly curved surface 29 of the die 18 is also beveled so as to have a convex frustum conic surface 30 generally confronting the frustum conic surface 28 of the die 16.

As is apparent in FIG. 5, the two frustum conic surfaces 28 and 30 are inclined one with respect to the other and thus diverge to the right as they appear in FIG. 5. During operation of the dies, the surfaces 28 and 30 approach one another so as to form a generally V-shaped channel (in cross section) in which the initially round wire portion 12 is received and re-formed, or coined, to a generally wedge-shaped wire identified after such re-formation by the reference number 34.

Simultaneously as the initially round (in cross section) wire portion 12 is coined between the dies to form the wedge-shaped wire 34 illustrated in FIG. 5, the wire 34 is curved along its length to match the curvature of the surfaces 28 and 30. Furthermore, the loops 14 are somewhat flattened to produce the loops 32 appearing to the right side of FIG. 1.

It can be noted, however, that the frustum conic surfaces 28 and 30 do not extend the entire distance between adjacent loops 14 of the wire being formed between the dies. Thus the die 16 has a relatively flat surface 40 extending from the left recess 24 therein to form an obtuse angle with the left end of the concave surface 26 in the die 16. The surface 40 is also beveled to provide an inclined working surface 42. As previously explained, the surfaces 40 and 42 are symmetrically duplicated on the right side of the die 16 and, of course, the operating surface of the die 18 is similarly formed in mirror image.

Accordingly, when the dies 16 and 18 cooperate to compress a section of looped wire therebetween, the section extending between adjacent loops is curved throughout a central portion of the section, but the resulting curvature of the wire terminates short of the loops in the wire with relatively straight end portions 36 which connect to the loops 14 and which are also wedge-shaped due to the beveled surfaces 42 appearing in the die 16 and corresponding beveled surfaces located in the operating face of the die 18.

In this regard, it will be noted that the initial flattening which occurs to the left side of each loop encircling the pin 20 is completed to a wedge shape in cross section after the same loop has been indexed to encircling relation to the pin 21 and the dies 16 and 18 again closed.

At first thought, one might consider that the curving of the wire segment extending between adjacent loops would require that the curved sections would have to be elongated by the operation of the dies. However, in actual practice, there is enough looseness between the loops 14 and the pins 20 and 21 that the curvature of the wire in the region between the straight portions 36 appears to be accommodated by a tightening of the loops about the pins 20 and 21, the net result presumably being that the internal diameters of the loops are moderately decreased. Thus the bending of the wire along its length appears to be essentially complete before the loops 14 encircling the pins 20 and 21 are placed under the full pressure developed by the dies 16 and 18.

As indicated in FIG. 1, the simultaneous curving and coining accomplished by the dies 16 and 18 is performed repeatedly on an indefinitely long segment of the looped wire, each portion of the indefinitely long segment which has been both curved and coined between the dies being indexed out of the dies as the next adjacent portion which is to be both curved and coined, is indexed into the region between the dies. In order to allow the dies to cooperate to curve and coin the new section indexed into the dies without disturbing the curvature created in the section of the looped wire just indexed out of the dies, the cooperating dies have relieved surfaces 43, best shown in FIG. 3, which accommodate the curvature of the wire section coined in the immediately prior operating step. Also, while the dies 16 and 18 are shown as operating against a wire indexed to the right as the dies appear in FIG. 1, it is apparent that the same dies, being symmetric, would operate with equal efficiency if the wire would have been indexed to the left as the dies appear in FIG. 1.

FIG. 6 illustrates the cross sectional shape of the curved wire 34 extending between the loops of the completely formed wire. As can be noted in FIG. 6, the resulting wedge shape includes relatively large and divergent surfaces 48 bridged at their position of greatest divergence by a generally circularly curved surface 44 and bridged where the surfaces most closely approach one another by a generally circular surface 46 having a radius of curvature smaller than the radius of curvature for the surface 44.

Regarding the construction of the dies 16 and 18, those skilled in the art will understand that the concave surface 26 of the die 16 is formed by generating a cylindrical section about an axis disposed centrally above the die 16 and that the concavely frustum surface 28 is generated about the same axis. Likewise, the convexly curved surface 29 is also generated about an axis disposed above the die 18 and the frustum surface 30 is generated about the same axis. In the operation of the dies, the dies 16 and 18 are initially spaced apart such that their respective generating axes are spaced apart and are then moved one toward the other in such direction that the respective generating axes of the two dies approach coincidence. It can be noted from the arrow 45 in FIG. 1 that the direction in which the dies are moved to approach their respective generating axes toward coincidence is a direction generally perpendicular to the direction in which the inclined surfaces 42 which form the straight wire portions 46 extend.

In a preferred embodiment having dies sized to process looped wire which is initially approximately one-sixteenth inch in diameter and provided with loops spaced apart approximately 3.75 inches center to center, the pins 20 and 21 are also spaced 3.75 inches center to center and are approximately one-quarter inch in diameter. The loops 14 are correspondingly formed with an initial internal diameter of approximately nine-sixteenths of an inch. The surfaces 26 and 29 of the dies 16 and 18 are formed on an approximately three-inch radius, and the frustum conic surfaces 28 and 30 each form an angle of seven degrees with the axes about which the surfaces 26 and 29 are generated. Likewise, the surfaces 42 are beveled to an angle of seven degrees with respect to the plane occupied by the surfaces 40. As a consequence, the surfaces 48 in the finally coined wire form an included angle of approximately fourteen degrees. The width of the finally formed wire between the surfaces 46 and 44 thereof is approximately one-eighth of an inch, this being approximately twice the original diameter of the looped wire before the coining thereof.

FIG. 7 illustrates, in fragmentary detail, a manner in which a plurality of looped wires 62 which have been curved and coined in accordance with the present invention can be assembled into a screen 58. The screen comprises a plurality of wires 62 which are placed in adjacent relationship with the curved portions of one wire nesting into the adjacent curved portions of the next adjacent wire and with the loops thereof juxtaposed. Support rods 54 passing through the juxtaposed loops are received in apertures located in upper and lower frame members 50 and 52, respectively. To preserve the curvature built into the juxtaposed wires 62, bushings 56 encircle the support rods 54 adjacent the frame member 52. As the screen is assembled, the ends of the support rods 54 are upset into countersinks 60 formed in the outer faces of the frame members 50 and 52, thus to provide a generally rigid screen assembly. As indicated by fragmentation in FIG. 7, the screen 58 may be of any arbitrary length and any arbitrary width.

Although the preferred embodiment of this invention has been described, it will be understood that various changes may be made within the scope of the appended claims.

Having thus described my invention, I claim:

1. In an apparatus for simultaneously curving and cross sectionally shaping a wire portion: first and second dies adapted to be relatively moved in a given direction to compress said wire element therebetween, the first of said dies having a working surface comprising a segment of a convex frustum generated about a first axis disposed perpendicular to said given direction, the second of said dies having a working surface comprising a segment of a concave frustum generated about a second axis perpendicular to said given direction, said dies when moved in said given direction, moved toward coincidence of said first and second axes, the working surfaces of said respectively convex and concave frusta inclined one with respect to the other.

2. The apparatus of claim 1 wherein each of said dies has a second working surface extending outwardly from the frustum segment thereof, said second working surfaces extending generally perpendicular to said given direction, the second working surfaces inclined one with respect to the other.

3. The apparatus of claim 2 wherein said wire portion extends between spaced apart loops of a looped wire, each of said dies having recesses adapted to receive loops of said looped wire, the first-named working surface of each die disposed between the recesses of such die, and said second working surface of each die extending from the first-named working surface of such die toward a recess of such die.

4. The method of simultaneously curving and cross sectionally shaping a wire element with cooperating die elements, one of which includes a first working surface in the shape of a convex frustum generated about a first axis, the other of which includes a second working surface in the shape of a concave frustum generated about a second axis and inclined to said first working surface, which comprises moving said die elements relatively to compress said wire element between the frusta thereof in a direction which advances said first and second axes toward coincidence.

5. In an apparatus for shaping a wire portion extending between spaced apart loops of a looped wire wherein cooperating dies having loop-receiving recesses are moved relatively to engage spaced apart loops of said looped wire in said recesses, the improvements wherein a first of said dies has a convexly curved working surface disposed between loop-receiving recesses thereof, wherein the second of said dies has a concavely curved working surface disposed between loop-receiving recesses thereof and confronting said convexly curved working surface, and wherein one of said respectively convexly and concavely curved working surfaces is inclined relative to the other whereby said wire portion is simultaneously curved and coined to a wedge shape when said dies are moved relatively to engage said looped wire.

* * * * *